US006904256B2

(12) United States Patent
Sato et al.

(10) Patent No.: US 6,904,256 B2
(45) Date of Patent: Jun. 7, 2005

(54) IMAGE FORMING DEVICE

(75) Inventors: Shougo Sato, Seto (JP); Masashi Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/782,829

(22) Filed: Feb. 23, 2004

(65) Prior Publication Data

US 2004/0161269 A1 Aug. 19, 2004

Related U.S. Application Data

(62) Division of application No. 10/106,070, filed on Mar. 27, 2002, now Pat. No. 6,721,524.

(30) Foreign Application Priority Data

Mar. 30, 2001 (JP) ..... 2001-097773

(51) Int. Cl.[7] ..... G03G 15/20

(52) U.S. Cl. ..... 399/324; 399/223; 399/328; 399/333

(58) Field of Search ..... 118/645; 219/216; 399/223, 231, 252, 320, 321, 324, 328, 333; 430/42, 45, 47

(56) References Cited

U.S. PATENT DOCUMENTS

| | | | | |
|---|---|---|---|---|
| 5,627,629 A | | 5/1997 | Takahashi et al. | |
| 6,097,919 A | * | 8/2000 | Takeuchi et al. | 399/298 |
| 6,701,116 B1 | * | 3/2004 | Aoki | 399/298 |
| 6,721,524 B2 | * | 4/2004 | Sato et al. | 399/223 |

* cited by examiner

*Primary Examiner*—Hoang Ngo
(74) *Attorney, Agent, or Firm*—Oliff & Berridge, PLC

(57) ABSTRACT

An image forming device includes an image forming unit and a thermal fixing unit. The image forming unit uses a plurality of different color developing agents to form a color image on a recording medium. The plurality of different color developing agents are configured from binding resins with the same thermal properties. The plurality of different color developing agents include at least a high-resistance developing agent and a low-resistance developing agent. The high-resistance developing agent has a higher electrical resistance than the low-resistance developing agent and a lower charge-to-mass ratio than the low-resistance developing agent. The thermal fixing unit thermally fixes the color image onto the recording medium.

4 Claims, 1 Drawing Sheet

IMAGE FORMING DEVICE

This is a divisional of application Ser. No. 10/106,070 filed Mar. 27, 2002 U.S. Pat. No. 6,721,524 disclosure of the prior application is hereby incorporated by reference herein in its entirety.

BACKGROUND OF THE INVENTION

1. Field of the Invention

The present invention relates to an image forming device such as a color laser printer.

2. Description of the Related Art

One type of conventional color laser printer includes a plurality of photosensitive drums. A different color toner image is formed on each of the photosensitive drums. The different-colored toner images are then transferred from the photosensitive drums one on top of the other onto an intermediate transfer member. The superimposed visible images are then transferred together from the intermediate transfer member onto a sheet in order to form a color image on the sheet. Normally, a fixing unit is provided for fixing the color image onto the sheet.

Normally, the fixing unit includes a thermal roller and a pressing roller. When a sheet formed with a color toner image passes between the thermal roller and the pressing roller, the color toner image is thermally fixed onto the sheet.

Toner can undesirably cling to the thermal roller because of image forces exerted by the charge of the toner or Coulomb forces that accumulate at the surface of the thermal roller. This clinging toner can appear as ghost images in the visible color image fixed on the sheet. This problem can be referred to as electrostatic offset. Electrostatic offset can be prevented by adjusting the configuration of the laser printer in accordance with the charge-to-mass ratio and volume resistance of the toner. For example, a high-resistance element connected between the thermal roller and ground can be selected, or the surface of the thermal roller can be processed, in accordance with the charge-to-mass ratio and volume resistance of the toner.

SUMMARY OF THE PRESENT INVENTION

However, color images are normally formed from a combination of yellow, magenta, cyan, and black colored toners. Normally, black toner includes a conductive coloring agent, such as carbon black and so has a lower electrical resistance than do the yellow, magenta, and cyan toners. When the different toners that form a color image have different resistances in this way, it is difficult to make adjustments in accordance with charge-to-mass ratio and volume resistance of the color toners. Therefore, it is difficult to effectively prevent electrostatic offset.

It is an objective of the present invention to overcome the above-described problems and to provide an image forming device capable of properly fixing color images formed from a plurality of developing agents with different electrical resistances, without the problem of electrostatic offset occurring.

In order to achieve the above-described objectives, an image forming device according to the present invention includes an image forming unit and a thermal fixing unit. The image forming unit uses a plurality of different color developing agents to form a color image on a recording medium. The plurality of different color developing agents are configured from binding resins with the same thermal properties. The plurality of different color developing agents include at least a high-resistance developing agent and a low-resistance developing agent. The high-resistance developing agent has a higher electrical resistance than the low-resistance developing agent and a lower charge-to-mass ratio than the low-resistance developing agent. The thermal fixing unit thermally fixes the color image onto the recording medium.

Because the high-resistance developing agent has a lower charge-to-mass ratio than the low-resistance developing agent, image forces exerted by the charge of the high-resistance developing agent are reduced, so the developing agent does not cling as easily to the thermal roller. Therefore, even a color image formed from a plurality of developing agent types with different resistance values can be properly fixed to the sheet without fear of electrostatic offset occurring.

An image forming device according to another aspect of the present invention includes an image forming unit that uses high-resistance developing agent and the low-resistance developing agent that both have a charge-to-mass ratio of 20 $\mu$C/g or greater. However, the high-resistance developing agent is configured from a binding resin with a glass transition point that is lower than a glass transition point of a binding resin that configures the low-resistance developing agent.

Because the charge-to-mass ratio of all developing agents is adjusted to 20 $\mu$C/g or greater, the developing agents have sufficient clinging force so that disturbance in color images caused by generation of steam from the sheet can be effectively prevented. Because the high-resistance developing agent is configured from a binding resin that has a glass transition point lower than the glass transition point of the binding resin that configures the low-resistance developing agent, the high-resistance developing agent melts more easily so that the high-resistance developing agent can be fixed to the recording medium using the same fixing temperature as for the low-resistance developing agent, and consequently the high- and low resistance developing agents can be fixed simultaneously.

An image forming device according to another aspect of the present invention includes an image forming unit that uses different color developing agents that each have different electrical resistances and a volume resistance of $10^{10.5}$ ohm·cm or greater. The thermal fixing unit includes a heating member and a pressing member. The heating member contacts a surface of the recording medium formed with the color image. The pressing member presses the heating member through pressing contact with an opposite surface of the recording medium. At least one of the heating member and the pressing member has a surface resistance from $10^6$ to $10^{10}$ ohm and the other has a surface formed from an electrically insulating material.

Electrostatic offset can easily occur when the volume resistance of the developing agents is $10^{10.5}$ ohm·cm or greater. Furthermore, developing agent types with different resistance values also exert different image force by the charge of the developing agent. Therefore, it is difficult to fix all the developing agent types simultaneously under the same conditions.

The member formed with a surface made from an electrically insulating material can develop a negative charge as the recording medium rubs against it during fixing operations. However, because the other member is formed with a surface resistance of $10^6$ to $10^{10}$ ohm, a portion of the negative charge can escape through the surface of the other member. For this reason, charge of the developing agent will not be excessively influenced during fixing operations by the negative charge generated on the surface of the member so that proper fixing operations can be performed and color images can be properly fixed without generation of electrostatic offset.

BRIEF DESCRIPTION OF THE DRAWINGS

The above and other objects, features and advantages of the invention will become more apparent from reading the following description of the embodiment taken in connection with the accompanying drawing in which.

DETAILED DESCRIPTION OF THE EMBODIMENT

Figure 1:
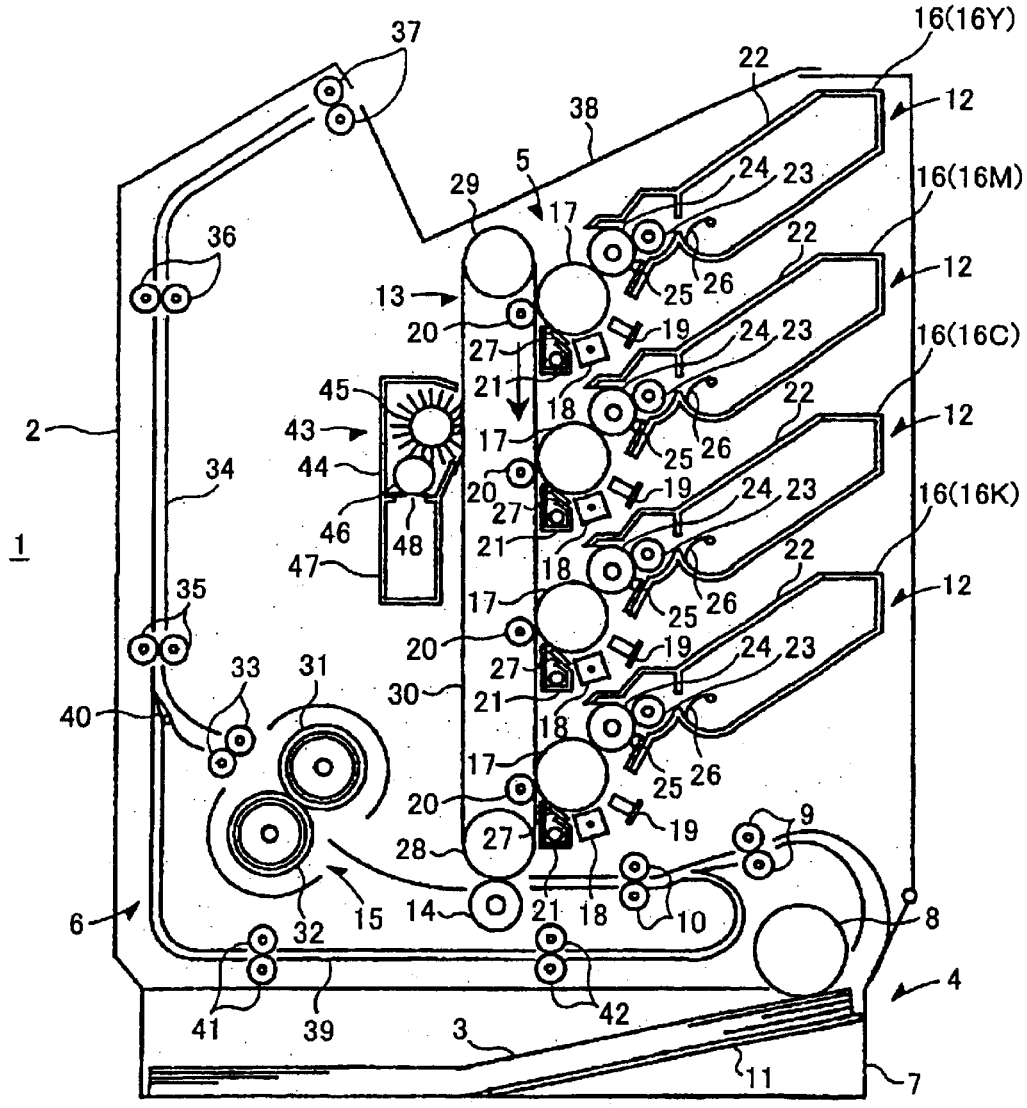
FIG. 1 is a cross-sectional view schematically showing a color laser printer according to an embodiment of the present invention.

Next, a color laser printer 1 according to an embodiment of the present invention will be described with reference to FIG. 1. As shown in FIG. 1, the color laser printer 1 includes a casing 2, a feeder portion 4, an image forming portion 5, and an inverse transport portion 6. The feeder portion 4, the image forming portion 5, and the inverse transport portion 6 are provided in the casing 2. The feeder portion 4 is for feeding sheets 3. The image forming portion 5 is for forming images on the fed out sheets 3. The inverse transport portion 6 is for forming images on both sides of the sheets 3.

The feeder portion 4 includes a sheet-supply tray 7, a sheet-pressing plate 11, a sheet-feed roller 8, transport rollers 9, and registration rollers 10. The sheet-supply tray 7 is detachably mounted in the lower portion in the casing 2. The sheet-feed roller 8 is disposed above one end of the sheet-supply tray 7. The transport rollers 9 are disposed downstream from the sheet-feed roller 8. The registration rollers 10 are provided downstream from the transport rollers 9. The sheet-pressing plate 11 is provided in the sheet-supply tray 7 and is disposed so that the end portion in confrontation with the sheet-feed roller 8 can move up and down. Sheets 3 are stacked in a pile on the sheet-pressing plate 11. A spring (not shown) urges the sheet-pressing plate 11 from the under surface of the sheet-pressing plate 11 so that the uppermost sheet 3 of the pile is pressed toward the sheet-feed roller 8. Rotation of the sheet-feed roller 78 feeds out one sheet at a time from the pile. Each sheet 3 that is fed out by the sheet-feed roller 8 is transported by the transport rollers 9 to the registration rollers 10. After the registration rollers 10 perform a registration operation on the sheet 3, the sheet is transported to the image forming portion 5.

The image forming portion 5 includes process portions 12, an intermediate transfer mechanism 13, a secondary transfer roller 14, and a fixing unit 15.

A process portion 12 is provided for each of four printing colors. The process portions 12 are provided in vertical alignment separated from each other by a predetermined spacing. Each process portion 12 includes a developing cartridge 16, a photosensitive drum 17, a scorotron charge unit 18, an LED array 19, a primary transfer roller 20, and a drum cleaner 21.

Each developing cartridge 16 is detachably mounted to other components of the corresponding process portion 12 and includes a toner holding portion 22, a supply roller 23, a developing roller 24, and a layer-thickness regulating blade 25. In the present embodiment, four developing cartridges 16 are provided, that is, a yellow developing cartridge 16Y, a magenta developing cartridge 16M, a cyan developing cartridge 16C, and a black developing cartridge 16K.

The toner holding portion 22 of each developing cartridge 16 is filled with a non-magnetic, single-component toner with positively charging properties. Each toner holding portion 22 holds a different colored toner, that is, the toner holding portion 22 of the yellow developing cartridge 16Y holds yellow toner, the toner holding portion 22 of the magenta developing cartridge 16M holds magenta toner, the toner holding portion 22 of the cyan developing cartridge 16C holds cyan toner, and the toner holding portion 22 of the black developing cartridge 16K holds black toner.

In the embodiment, each color toner is a polymer toner with substantially spherical particles. Because the different-colored toners are obtained using polymerization, the toner particles have a spherical shape with a uniform particle size. Therefore, all the toner types have extremely good fluidity. The polymerized toner types of the embodiment have an average particle size of 8 to 10 $\mu$m.

The polymer toners include binding resins as their main component. All the different color toners used in the color laser printer 1, that is, the yellow toner, the magenta toner, the cyan toner, and the black toner, are configured from binding resins that have the same thermal properties, that is, the same glass transition point (Tg) in the range of 60° to 65° C. It should be noted that two or more of the different color toners can be configured from the same binding resin. Each binding resin is made by copolymerizing a polymerizing monomer using a well-known polymerization method such as suspension polymerization. Examples of polymerizing monomers include styrene monomers, such as styrene, and acrylic monomers, such as acrylic acid, alkyl (C1–C4) acrylate, and alkyl (C1–C4) meta-acrylate.

The main toner particles are formed by adding coloring agents, charge regulators, and wax to the binding resins. In the present embodiment, the coloring agents are yellow, magenta, cyan, and black coloring agents. The charge regulating agents suppress the charge-to-mass ratio and the polarity of the different toners. Examples of charge regulators that can be used include a charge regulating resin obtained by copolymerizing an ionic monomer with a copolymerizing monomer. In this case, the ionic monomer can be an ammonium salt or other monomer with an ionic functional group. The copolymerizing monomer is capable of copolymerizing with the ionic monomer and can be a styrene monomer, an acrylic monomer, or other monomer with an ionic functional group.

An external additive, such as silica, is added to the toners for the purpose of increasing fluidity of the toners. Powders of various inorganic materials can be used as an external additive. For example, powders of a metallic oxide, a carbide, or a metallic salt can be used as an external additive. Examples of a metallic oxide powder that can be used as an external additive include silica, aluminum oxide (alumina), titanium oxide, strontium titanate, cerium oxide, magnesium oxide All of the different color toners are adjusted to a volume resistance of $10^{10.5}$ ohm·cm or greater and with a charge-to-mass ratio Q/M is 20 $\mu$C/g or greater to insure good quality images.

The volume resistance of the toner is determined in the following manner. The toner is punch pressed into a tablet with thickness of 2.00 mm+/−0.10 mm. The impedance of the tabletized sample is measured using a Q meter. The volume resistivity can be calculated from the measured impedance. The volume resistance is determined from the calculated volume resistivity. The volume resistance is alternately referred to as merely electrical resistance or resistance, hereinafter.

Although all of the different color toners are adjusted to a volume resistance of $10^{10.5}$ ohm·cm or greater, the different color toners exhibit different electrical resistances because the different color toners include different coloring agents and for other reasons. To compensate for potential problems that these different electrical resistances can cause, the charge regulating agents are included in the different toner types to adjust toners with high electrical resistances to have a lower charge-to-mass ratio Q/M than that of the toners with lower electrical resistances, although it should be noted that all toner types are adjusted to a charge-to-mass ratio Q/M of 20 $\mu$C/g or greater. The charge-to-mass ratio Q/M can be determined by measuring the toner using a Faraday gauge and the like, after the toner was transferred from the transfer roller 14 onto a sheet 3 and before the toner is fixed onto the sheet 3 at the fixing portion 15.

In the embodiment, the black toner includes conductive carbon black as its coloring agent, and so exhibits a lower electrical resistance than the yellow, magenta, and cyan toners, referred to collectively as the YMC toners, hereinafter. Because the YMC toners exhibit higher resistance values than the resistance value of the black toner, charge regulating agent is added to the different toner types to provide the YMC toners with a lower charge-to-mass ratio Q/M than that of the black toner. In the present embodiment, more charge regulating agent is added to the black toner than to the YMC toners.

Each toner holding portion 22 includes an agitator 26 and is formed with a toner-supply opening in its side. The agitator 26 agitates the toner in the toner holding portion 22 and discharges the toner from a toner-supply opening to the corresponding supply roller 23.

Each supply roller 23 is rotatably disposed to the side of the corresponding toner supply opening in the corresponding toner holding portion 22. Each developing roller 24 is rotatably disposed in confrontation with the corresponding supply roller 23 so that the supply roller 23 and the developing roller 24 are in abutment with each other, with the supply roller 23 compressed by a certain amount.

Each supply roller 23 is formed from a metal roller shaft covered by a conductive sponge member.

Each developing roller 24 is made from a metal roller shaft covered by a resilient member, which is made from conductive rubber. More specifically, the roller of each developing roller 24 has a two-layer configuration including a roller portion and a surface coat layer. The roller portion is formed from a conductive resilient material such as EPDM rubber, silicon rubber, urethane rubber incorporated with, for-example, carbon particles. The surface coat layer covers the surface of the roller portion. Examples of the main component of the surface coat layer include urethane rubber, urethane resin, and polyimide resin. A predetermined developing bias is applied to the developing rollers 24 with respect to the photosensitive drum 17.

Each layer-thickness regulating blade 25 is disposed near the corresponding developing roller 24. Each layer-thickness regulating blade 24 includes a metal plate spring and a pressing portion attached to the free end of the plate spring. The pressing portion is formed from silicon rubber, which has electrical insulation properties. The pressing portion has a half circle shape in cross section. Each layer-thickness regulating blade 24 is supported on the corresponding developing cartridge 16 at a position near the corresponding developing roller 25 so that the pressing portion is pressed against the developing roller 25 by resiliency of the plate spring.

Rotation of each supply roller 23 supplies the toner from the toner supply opening to the corresponding developing roller 24, where friction between the supply roller 23 and developing roller 24 charges the toner to a positive charge. The toner borne on each developing roller 24 enters between the developing roller 24 and the pressing portion of the corresponding layer-thickness regulating blade 25 in association with rotation of the developing roller 24, where the toner is sufficiently charged by friction between the pressing portion and the developing roller 24 and regulated to a thin layer with a uniform thickness on the developing roller 24.

Each photosensitive drum 27 is disposed to the side of the corresponding developing roller 24 and is rotatably in contact with the developing roller 24. The drum body of each photosensitive drum 17 is grounded. The surface of each photosensitive drum 17 is formed from a photosensitive layer of an organic photosensitive body with polycarbonate as its main component.

Each scorotron charge unit 18 is disposed below the corresponding photosensitive drum 17, separated by a predetermined distance from the photosensitive drum 17 so as not to contact the photosensitive drum 17. The scorotron charge units 18 are scorotron charge units that, in order to positively charge the surface of the photosensitive drums 17, generate a corona discharge from a charge wire made from tungsten, for example. Each scorotron charge unit 18 charges the surface of the corresponding photosensitive drum 17 to a uniform positive charge.

Each LED array 19 is disposed below the corresponding photosensitive drum 17 and is disposed in between the scorotron charge unit 18 and the developer roller 24 with respect to the rotational direction of the photosensitive drum 17. Each LED array 19 is configured from a plurality of LEDs aligned in a row. The LEDs emit light based on image data and irradiate and expose the surface of the corresponding photosensitive drum 17.

The process portions 12 perform exposure and development processes in substantially the same manner, but for the different toner colors. Here, exposure and development processes will be described for a representative process portion 12. As the photosensitive drum 17 rotates, the scorotron charge unit 18 charges the surface of the photosensitive drum 17 uniformly to a positive charge, and the LED array 19 emits light to expose the surface of the photosensitive drum 17, thereby forming a static-electric latent image based on image data on the surface of the photosensitive drum 17. Next, as the developing roller 24 confronts and contacts the photosensitive drum 17, rotation of the developing roller 24 supplies positively-charged toner that is borne on the developing roller 24 to the static-electric latent image formed on the surface of the photosensitive drum 17. At this time, the toner is selectively borne on only portions of the photosensitive drum 17 that were exposed by the LED array 19. That is, when the LED array 19 exposes portions of the uniformly positively charged surface of the photosensitive drum 17, the electric potential drops at the exposed portion. The supplied toner is selectively transferred to only the exposed portions, thereby developing the static-electric latent image into a visible toner image. Thus, an inverse development operation is performed.

Each primary transfer roller 20 is disposed at a position downstream from the corresponding developing roller 24 with respect to the rotational direction of the photosensitive drum 17. Each primary transfer roller 20 is disposed in confrontation with the corresponding photosensitive drum 17, with an endless belt 30 sandwiched between the photosensitive drum 17 and the primary transfer roller 20. Each primary transfer roller 20 is made from a metal roller shaft covered with a conductive rubber material. Each primary transfer roller 20 is rotated by drive from the corresponding photosensitive drum 17. A predetermined transfer bias is applied to the transfer rollers 20 with respect to the corresponding photosensitive drum 17, so that the visible toner image borne on the photosensitive drums 17 is transferred to the endless belt 30 that passes between the photosensitive drums 17 and the primary transfer rollers 20.

The drum cleaners 21 are for collecting residual toner from the photosensitive drums 17. Each drum cleaner 21 is disposed between the corresponding primary transfer roller 20 and the corresponding scorotron charge unit 18 with respect to the rotational direction of the photosensitive drum 17. Each drum cleaner 21 has a box shape formed with an opening where it confronts the photosensitive drum 17. A scraping blade 27 is provided in the opening. The free end of the scraping blade 27 contacts the surface of the photosensitive drum 17. Residual toner that remains on the surface of the photosensitive drum 17 after the visible toner image is transferred is scraped off from the photosensitive drum 17 by the scraping blade 27 and collected inside the drum cleaner 21.

The intermediate transfer mechanism 13 is disposed in the casing 22 so as to extend vertically in confrontation with the photosensitive drums 17. The intermediate transfer mechanism 13 includes first and second rollers 28, 29, and the endless belt 30. The first roller 28 is provided at the bottom side of the intermediate transfer mechanism 13 and the second roller 29 is provided at the upper side of the intermediate transfer mechanism 13. The endless belt 30 is wound around the outer periphery of the first and second rollers 28, 29. The surface of the endless belt 30 that receives transfer of the visible toner image moves downward as indicated by the arrow in FIG. 1 by rotation of the first and second rollers 28, 29.

Rotation of the first and second rollers 28, 29 moves any particular portion of the endless belt 30 into and out of confrontation with the different photosensitive drums 17. The visible toner images formed on the different photosensitive drums 17 are transferred one at a time in order onto the endless belt 30. When the different visible toner images become superimposed on each other in this way, a color image results. Described in more detail, after the yellow visible toner image formed on the photosensitive drum 17 by the yellow toner that fills the yellow developing cartridge 16Y is transferred onto the endless belt 30, then the magenta visible toner image formed on the photosensitive drum 17 by the magenta toner that fills the magenta developing cartridge 16Y is transferred onto the endless belt 30 so as to overlap the yellow toner image. In a similar manner, the cyan visible toner image formed by toner from the cyan developing cartridge 16K and the black visible toner image formed by toner from the black developing cartridge 16K are transferred in this order onto the endless belt 30 to form a color image on the endless belt 30.

The secondary transfer roller 14 is rotatably provided at a position in confrontation with the first roller 28 of the intermediate transfer mechanism 13, with sheets 3 sandwiched therebetween. The secondary transfer roller 14 is formed from a metal roller shaft covered by a conductive rubber material. The secondary transfer roller 14 is applied with a predetermined transfer bias. The color image formed on the endless belt 30 is transferred all at once onto a sheet 3 that passes between the endless belt 30 and the secondary transfer roller 29.

The fixing portion 15 is disposed downstream from the secondary transfer roller 14 with respect to the transport direction of the sheet 3. The fixing portion 15 includes a first and second thermal rollers 31, 32 and a pair of transport rollers 33. The first thermal roller 31 contacts the upper surface of the sheet 3 on which a color toner image was transferred. The second thermal roller 32 is disposed in confrontation with the first thermal roller 31 so that transported sheets 3 are sandwiched between the thermal rollers 31, 32. The second thermal roller 32 contacts the lower surface of the sheets 3. The pair of transport rollers 33 are provided downstream from the thermal rollers 31, 32 in the direction of sheet transport.

The first thermal roller 31 includes a tube, a halogen lamp, and a resilient layer. The tube is made from a metal, such as aluminum, in a cylindrical shape. The halogen lamp is disposed in the tube for heating up the tube. The resilient layer is provided on the outside of the tube. The second thermal roller 32 has the same configuration as the first thermal roller 31. That is, the second thermal roller 32 includes a tube, a halogen lamp, and a resilient layer. The tube is made from a metal, such as aluminum, in a cylindrical shape. The halogen lamp id disposed in the tube for heating up the tube. The resilient layer is provided on the outside of the tube. The second thermal roller 32 presses against the first thermal roller 31. The color image transferred onto a sheet 3 by the secondary transfer roller 14 is heatedly fixed onto the sheet 3 as the sheet 3 passes between the pair of thermal rollers 31, 32. Afterward, the transport rollers 33 transport the sheet 3 to a discharge path 34.

The discharge path 34 is provided following the vertical direction of the casing 2. Two pairs of transport rollers 35 and 36 are provided exposed into the discharge path 34. A pair of sheet-discharge rollers 37 are provided at the discharge port of the discharge path 34.

A sheet 13 that has been transported to the discharge path 34 by the transport rollers 33 of the fixing portion 15 is transported by the transport rollers 35 and 36 and discharged onto the discharge tray 38 by the sheet-discharge rollers 37.

The inverted transport portion 6 includes an inverted transport path 39 and a flapper 40. The flapper 40 switches direction in which sheets 3 are transported. The inverted transport path 39 is connected at one end to the discharge path 44 at a position near the transport rollers 45 and at the other end to the sheet transport path that extends between the transport rollers 9 and the registration rollers 10. Also two pairs of inverted transport rollers 41, 42 are disposed so as to be exposed in the inverted transport path 39.

The flapper 40 is swingably provided at the junction of the discharge path 34 and the inverted transport path 39. Although not shown in the drawings, a path switching solenoid is provided for switching the flapper 40 back and forth. That is, by selectively energizing and not energizing the path switching solenoid, the transport direction of a sheet 3 that has a color image formed on one side can be switched to the discharge path 44 or from the discharge path 44 to the inverted transport path 39.

Next, operations for forming images on both sides of a sheet 3 will be described. Once a sheet 3 formed with an image on one side is transported from the transport rollers 33 to the transport rollers 35, then the transport rollers 35 rotate forward with the sheet 3 sandwiched therebetween, so that the sheet 3 is transported upward toward the discharge path 34. The sheet 3 is transported most of the way into the discharge path 34 until the end edge of the sheet 3 is sandwiched between the transport rollers 35. Then, the positive rotation of the transport rollers 35 is stopped and the transport rollers 35 are driven to rotate in the opposite direction. At this time, the solenoid is energized to switch the flapper 40 to guide the sheet 3 to the inverted transport path 39. As a result, the transport rollers 35 transport the sheet 3 backwards through the discharge path, with front and rear edges reversed, downward toward the inverted transport path 39. It should be noted that once transport of the sheet 3 into the inverted transport path 39 is completed, the flapper 40 is switched back into its initial position for guiding sheets 3 from the transport rollers 33 toward the sheet-discharge path 44. The inverted transport rollers 41, 42 transport the sheet 3 that was transported backwards into the inverted transport path 49 to the registration rollers 10, which subject the sheet 3 to a registration operation. Then the sheet is again formed with an image while in an upside down condition, so that an image is formed on both sides of the sheet 3.

A belt cleaner 43 is provided for collecting toner that remains on the endless belt 40 after the entire color image is transferred onto the sheet 3 at the same time. The belt cleaner 43 is disposed to the side of the intermediate transfer mechanism 13 and includes a cleaner casing 44, a cleaner brush 45, a collection roller 46, a collection box 47, and a scraping blade 48. The cleaner casing 44 is disposed between the first roller 28 and the second roller 29 and houses the other components of the belt cleaner 43.

The cleaner brush 45 is made from a cylindrical body formed with radially extending filaments. The cleaner brush 45 is rotatably disposed in confrontation with and in contact with the endless belt 40. A cleaning bias is applied to the cylindrical body of the cleaner brush 45 so as to develop a predetermined potential difference between the cleaner brush 45 and the endless belt 40.

The collection roller 46 is formed from a metal roller and is rotatably disposed below the cleaner brush 45 so as to be in confrontation with and in contact with the filaments of the cleaner brush 45. The collection roller 46 is applied with a bias so as to develop a predetermined bias between the collection roller 46 and the cleaner brush 45.

The collection box 47 is provided below the collection roller 46 and has an opening that faces the collection roller 46. The scraping blade 48 is provided near the opening in pressing contact with the collection roller 46.

When the endless belt 30 is transported into confrontation with the cleaner brush 45, the cleaner brush 45 scrapes toner that remains on the endless belt 30 after the color image is transferred onto the sheet 3. Also the toner clings to the cleaner brush 45 because of the cleaning bias applied to the cleaner brush 45. Afterward, because of the bias applied to the collection roller 46, the toner that clings to the cleaner brush 45 clings to the collection roller 46 when it is brought into confrontation with the collection roller 46. Next, the scraping blade 48 scrapes the toner off from the collection roller 46 into the collection box 47.

The color laser printer 1 includes a photosensitive drum 17 and a developing roller 24 for each color. The visible toner images formed for different colors are transferred in order. This is referred to as a tandem type color laser printer, which can form a color image at substantially the same speed as a monochrome image. Further, because the tandem-type color laser printer 1 uses polymerized toner, color images with extremely high quality can be formed.

The fixing unit 15 simultaneously fixes color images made from different colors having different resistance values. Therefore, it is difficult to make adjustments, such as adjusting a high-resistance element provided between the first thermal roller 31 and ground or processing the surface of the first thermal roller 31, in accordance with charge-to-mass ratio and resistance of all the toners, that is, in accordance with the charge-to-mass ratio and resistance of both the low-resistance black toner and the high-resistance YMC toners. In such a situation, electrostatic offset can easily occur. Electrostatic offset appears as ghost images in the visible color image on the sheet because of toner that clings to the thermal roller. The toner can cling to the thermal roller because of image force exerted by the charge of the toner or Coulomb force accumulated at the surface of the thermal roller.

Electrostatic offset is more likely to occur with high-resistance toner because charge does not easily escape from high-resistance toner. To prevent this, it is conceivable to use a higher fixing temperature for high-resistance toner (YMC toners) than for low-resistance toner (black toner) because charge can be removed by melting the toner. By melting the high-resistance toner, and thereby removing the charge from the toner, the high-resistance toner can be prevented from clinging to the thermal roller.

However, the color laser printer 1 is able to use the same low fixing temperature for both the high- and low-resistance toners because the high-resistance toner (YMC toners), which includes the same binding resin with the same thermal properties as the low-resistance toner, is adjusted to have a charge-to-mass ratio that is lower than the charge-to-mass ratio of the low-resistance toner. As a result, image forces exerted by the charge of the high-resistance toner are reduced, so the toner does not cling as easily to the thermal roller. With this configuration, color images formed from a plurality of toner types with different resistance values, in particular, the low-resistance black toner and the high-resistance YMC toners, can be properly fixed to the sheet without fear of electrostatic offset occurring.

The inventors made black toner and YMC toners from binding resin having the same thermal properties. The black toner had a volume resistance of $10^{11.5}$ ohm·cm and the YMC toners had a volume resistance of $10^{12}$ ohm·cm. Thermal fixing operations were performed for these toners using the same process speed of 80 mm/sec and charge-to-mass ratio of 35 $\mu$C/g for both the black toner and the YMC toners. Under these conditions, the black toner and the YMC toners had fixing temperature ranges with different lowest temperatures, that is, a lowest temperature of 185° C. for the black toner and 190° C. for the YMC toners. However, when thermal fixing operations were performed under the same conditions for the black toner, but with the charge-to-mass ratio of the YMC toners lowered to 20 $\mu$C/g, the lowest fixing temperature of both the black and YMC toners was standardized at the same 185° C. As a result, both the black and YMC toners could be thermally fixed at the same time.

All the different toners used in the color laser printer 1 are adjusted to have a charge-to-mass ratio of 20 $\mu$C/g or greater. When the charge-to-mass ratio of toner is too small, then the toner will cling to sheets with only a small force. When toner with such a small clinging force accumulates thickly on the sheet, as is the case when a full color image is formed, then when the sheet is heated, the steam generated from moisture in the sheet scatters the thickly-layered toner so that the toner image is disrupted as a result.

However, such disruption in the image is effectively prevented because the charge-to-mass ratio of all toners is adjusted to 20 $\mu$C/g or greater. Even though the charge-to-mass ratio of all toners is adjusted to 20 $\mu$C/g or greater in this manner, the charge-to-mass ratio of high-resistance toner (the YMC toners) is adjusted to lower than the charge-to-mass ratio of the low-resistance toner (the black toner) so that electrostatic offset can be effectively prevented.

All of the toners have volume resistance adjusted to $10^{10.5}$ ohm·cm or greater in order to form good color images. Although such a high volume resistance increases the risk that electrostatic offset will occur, electrostatic offset is effectively prevented because the high-resistance toner (the YMC toners) is adjusted to have a lower charge-to-mass ratio than the low-resistance toner (the black toner). For this reason, the color laser printer 1 reliably prevents electrostatic offset and can fix color images properly.

Alternately, in addition to adjusting the toners to have the charge-to-mass ratio of 20 $\mu$C/g or greater, the high-resistance toner (the YMC toners) can be configured from a binding resin with a glass transition point that is lower than glass transition point of the binding resin that configures the low-resistance toner (the black toner).

When the charge-to-mass ratio of toner is too small, then the toner will cling to sheets with only a small force. When toner with such a small clinging force accumulates thickly on the sheet, as is the case when a full color image is formed, then when the sheet is heated, the steam generated from moisture in the sheet scatters the thickly-layered toner so that the toner image is disrupted as a result. However, such disturbance of the image can be effectively prevented by adjusting the charge-to-mass ratio of all toners to 20 $\mu$C/g or greater. However, the high-resistance toner (YMC toner) is more likely to generate electrostatic offset and so has a higher fixing temperature than that of the low-resistance toner (black toner). When the charge-to-mass ratio of all toners is adjusted to 20 $\mu$C/g or greater in this manner, electrostatic offset is more likely to occur with the high-resistance toner (the YMC toners). However, when the high-resistance toner (the YMC toners) is configured from a binding resin that has a glass transition point lower than the glass transition point of the binding resin that configures the low-resistance toner (the black toner), the high-resistance toner (the YMC toners) melts more easily so that the fixing temperature used to fix the high-resistance toner (the YMC toners) can be lowered. Therefore, by adjusting the glass transition point of the toners in this way, disturbances in the toner image caused by generation of steam when the toner image is thermally fixed can be prevented and all of the different toners can be properly fixed simultaneously without generation of electrostatic offset even if a color image is formed from different toners that have different resistance values, that is, from the low-resistance black toner and the high-resistance YMC toners.

The inventors adjusted the charge-to-mass ratio of both color and black toners to 35 $\mu$C/g. The YMC toners were configured from a binding resin with glass transition point of 61° C. and the black toner was made from a binding resin with glass transition point of 63° C. In this case, both the black and YMC toners had a fixing temperature region with the same lower limit temperature of 185° C. so that both toner types could be thermally fixed simultaneously.

It is desirable that all the toner types have volume resistance adjusted to $10^{10.5}$ ohm·cm or greater in order to form good color images. Because this condition also increases the likelihood that electrostatic offset will occur, the temperature required to thermally fix the images would normally need to be increased. However The fixing temperature can be reduced because the high-resistance toner (the YMC toners) is configured from a binding resin with a glass transition point that is lower than the glass transition point of the binding resin that configures the low-resistance toner (the black toner). Therefore, all the toner types can be simultaneously fixed even if they have volume resistance adjusted to $10^{10.5}$ ohm·cm or greater. As a result, electrostatic offset can be reliably prevented so that color images can be even more properly fixed.

Alternately, in addition to adjusting the toners to have volume resistance of $10^{10.5}$ ohm·cm or greater, one of the thermal rollers 31, 32 can be formed with a surface resistance of $10^6$ to $10^{10}$ ohm and the other can be formed with a surface made from an electrically insulating material.

That is, electrostatic offset can easily occur when the volume resistance of the toners is set to $10^{10.5}$ ohm·cm or greater. Furthermore, toner types with different resistance values, that is, the high-resistance toner (the YMC toners) and the low-resistance toner (the black toner), also exert different image force exerted by the charge of the toner. Therefore, it is difficult to fix all the toner types simultaneously under the same conditions.

When one of the thermal rollers 31, 32 is formed with a surface made from an electrically insulating material, such as a fluoride material, the electrically insulating material surface can become charged to a negative charge when the sheet 3 rubs against the electrically insulating material surface during fixing operations. However, when the other of the thermal rollers 31, 32 is formed with a surface resistance of $10^6$ to $10^{10}$ ohm, a portion of the negative charge can escape through the surface of the other roller. For this reason, charge of the toner will not be excessively influenced during fixing operations by the negative charge generated on the surface of the thermal rollers 31, 32, so that proper fixing operations can be performed. Color images can be properly fixed without generation of electrostatic offset, even if all of the different toner types have a volume resistance of $10^{10.5}$ ohm·cm or greater and moreover the different toner types have charges that exert different image forces.

It is desirable that all of the toner types be adjusted with a charge-to-mass ratio of 20 $\mu$C/g or greater. When the charge-to-mass ratio of toner is too small, then the toner will cling to sheets with only a small force. When toner with such a small clinging force accumulates thickly on the sheet, as is the case when a full color image is formed, then when the sheet is heated, the steam generated from moisture in the sheet scatters the thickly-layered toner so that the toner image is disrupted as a result. However, such disturbance of the image can be effectively prevented by adjusting the charge-to-mass ratio of all toners to 20 $\mu$C/g or greater.

The first thermal roller 31 includes a cylindrical tube made from metal, such as aluminum, and a resilient layer provided on the outside of the tube. The outer surface of the resilient layer is coated with Teflon™ (polytetrafluoroethylene) or PFA (tetrafluoroethylene/perfluoroalkyl vinyl ether copolymer). Alternatively, the first thermal roller 31 can have a tube shape covered with a cover. In either case, the coating or the cover is dispersed therethrough with conductive particles, such as carbon, in order to form a surface resistance of $10^6$ to $10^{10}$ ohm. The outer surface of the second thermal roller 32 is coated with Teflon™ or PFA, or alternatively is a tube shape covered with an electrically insulating cover.

Because the surface of the second thermal roller 32 is formed from a coating of electrically insulating Teflon™ or PFA, or the second thermal roller 32 is a tube formed with an electrically insulating cover, the electrically insulating surface can become charged to a negative charge when the sheet 3 rubs against the electrically insulating material surface during fixing operations. However, because the first thermal roller 31 is formed with a surface resistance in the range of $10^6$ to $10^{10}$ ohm, a portion of the negative charge can escape through the surface of the first thermal roller 31. For this reason, during fixing operations, the positive charge of the toner will be drawn to the negative charge generated on the surface of the thermal rollers 31, 32, so that proper fixing operations can be performed without the toner peeling off from the sheet. Color images can be properly fixed without generation of electrostatic offset, even if all of the different toner types have a volume resistance of $10^{10.5}$ ohm·cm or greater and moreover the different image forces are exerted by the different charges of the different toner types.

The inventors made a first thermal roller 31 with its surface covered with electrically insulating PFA. The inventors made second thermal rollers 32 with surface resistances of $10^5$ ohm, $10^6$ ohm, $10^7$ ohm, $10^8$ ohm, $10^9$ ohm, $10^{10}$ ohm, $10^{11}$ ohm, respectively. Color images that had been transferred to a sheet 3 were fixed to the sheet 3 using these first and second thermal rollers 31, 32 and the resultant fixed images were observed. It was observed that only the color image fixed using the second thermal roller 32 with surface resistances of $10^{11}$ ohm included a ghost equivalent to the length of the outer circumference of the first thermal roller 31. The color images fixed using the second thermal roller 32 with surface resistances of $10^5$ ohm to $10^{10}$ ohm included no ghosts.

Although the color laser printer 1 is described as using toner with a positively charging nature, toner with a negatively charging nature can be used instead. In this case, the charge unit 18, the applied bias and the like need to be set to the opposite polarity also. Also, the first thermal roller 31 needs to be formed with an electrically insulating surface, such as a coating of Teflon™ or PFA, or formed in a tube shape covered with an electrically insulating cover and the second thermal roller 32 needs to be provided with a surface resistance of $10^5$ ohm to $10^{10}$ ohm by coating the surface with Teflon™ or PFA dispersed with conductive particles, such as carbon, or by forming the second thermal roller 32 in a tube shape covered by a cover dispersed with conductive particles, such as carbon.

Because the surface of the first thermal roller 31 is formed from a coating of electrically insulating Teflon™ or PFA, or the first thermal roller 31 is a tube formed with an electrically insulating cover, the electrically insulating surface can become charged to a negative charge when the sheet 3 rubs against the electrically insulating material surface during fixing operations. However, because the first thermal roller 31 is formed with a surface resistance in the range of $10^6$ to $10^{10}$ ohm, a portion of the negative charge can escape through the surface of the second thermal roller 32. For this reason, during fixing operations, the negative charge of the toner will be repelled by the negative charge generated on the surface of the first thermal roller 31, so that proper fixing operations can be performed without the toner peeling off from the sheet 3. Color images can be properly fixed without generation of electrostatic offset, even if all of the different toner types have a volume resistance of $10^{10.5}$ ohm·cm or greater and moreover different image forces are exerted by the different charges the different toner types.

While the invention has been described in detail with reference to specific embodiments thereof, it would be apparent to those skilled in the art that various changes and modifications may be made therein without departing from the spirit of the invention, the scope of which is defined by the attached claims.

For example, the first and second thermal rollers 31, 32 are described in the embodiment as including a tube formed from a metal, such as aluminum, and a halogen lamp disposed in the tube. However, if the second thermal roller 32 is used as a pressure roller for pressing against the first thermal roller 31, then there is no need to provide the second thermal roller with a halogen lamp.

Although the embodiment described the invention applied to tandem-type a color laser printer 1, the invention could be applied to a color laser printer that forms different color images on a single photosensitive drum and then transfers the color images one at a time superimposed on each other on a single intermediate member. The superimposed images are then transferred from the intermediate member onto a sheet.

What is claimed is:

1. An image forming device comprising:

an image forming unit that uses a plurality of different color developing agents to form a color image on a recording medium, each of the plurality of different color developing agents having a different electrical resistance and a volume resistance of $10^{10.5}$ ohm·cm or greater; and a thermal fixing unit including a heating member and a pressing member, the heating member contacting a surface of the recording medium formed with the color image, the pressing member pressing the heating member through pressing contact with an opposite surface of the recording medium, at least one of the heating member and the pressing member having a surface resistance from $10^6$ to $10^{10}$ ohm and the other of the least one of the heating member and the pressing member having a surface formed from an electrically insulating material.

2. An image forming device as claimed in claim 1, wherein each developing agent has a charge-to-mass ratio of 20 $\mu$C/g or greater.

3. An image forming device as claimed in claim 1, wherein each developing agent has a positively charging nature, the heating member having a surface resistance of between $10^6$ to $10^{10}$ ohm and the pressing member having a surface made from electrically insulating material.

4. An image forming device as claimed in claim 1, wherein each developing agent has a negatively charging nature, the heating member having a surface made from electrically insulating material and the pressing member having a surface resistance of between $10^6$ to $10^{10}$ ohm.

* * * * *